US008492976B2

(12) United States Patent
Takama et al.

(10) Patent No.: US 8,492,976 B2
(45) Date of Patent: Jul. 23, 2013

(54) HIGH PRESSURE DISCHARGE LAMP

(75) Inventors: Atsushi Takama, Hyogo (JP); Tetsuji Hirao, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/638,334

(22) PCT Filed: Mar. 17, 2011

(86) PCT No.: PCT/JP2011/056387
§ 371 (c)(1),
(2), (4) Date: Sep. 28, 2012

(87) PCT Pub. No.: WO2011/122359
PCT Pub. Date: Oct. 6, 2011

(65) Prior Publication Data

US 2013/0026912 A1 Jan. 31, 2013

(30) Foreign Application Priority Data

Mar. 30, 2010 (JP) ..... 2010-077155

(51) Int. Cl.
*H01J 17/04* (2012.01)

(52) U.S. Cl.
USPC ..... 313/631; 313/623

(58) Field of Classification Search
None
See application file for complete search history.

(56) References Cited

U.S. PATENT DOCUMENTS 6,586,891 B2 * 7/2003 Kaneko et al. ..... 315/246
6,597,118 B2 * 7/2003 Arimoto et al. ..... 315/115
6,657,383 B2 12/2003 Matsushima et al.
7,034,460 B2 * 4/2006 Takahashi et al. ..... 313/626
7,057,345 B2 * 6/2006 Kikuchi et al. ..... 313/595
7,560,865 B2 * 7/2009 Katou et al. ..... 313/625
2002/0047610 A1 * 4/2002 Arimoto et al. ..... 315/246
2002/0163315 A1 * 11/2002 Kaneko et al. ..... 315/246
2002/0185972 A1 * 12/2002 Matsushima et al. ..... 313/570

(Continued)

FOREIGN PATENT DOCUMENTS

JP 07-296780 A 11/1995
JP 09-265947 A 10/1997

(Continued)

OTHER PUBLICATIONS

International Search Report, maild May 10, 2011.

(Continued)

*Primary Examiner* — Mary Ellen Bowman
(74) *Attorney, Agent, or Firm* — Rader, Fishman & Grauer PLLC

(57) ABSTRACT

A high pressure discharge lamp includes a light emission section in which a pair of electrodes is arranged, sealing portions formed from both ends of the light emission section, external leads, and a trigger wire provided near the light emission section. The trigger wire includes a first coil portion, which is wound from a vicinity of a boundary between the light emission section and one of the sealing portions towards an outer end of the one of sealing portions, and a linear stretch-across portion, which extends from the first coil portion near the light emission section towards the external lead extending from an outer end of the other sealing portion and is fixed to the external lead. A second coil portion is formed around the other sealing portion. The wire, which forms the stretch-across portion, is held between the second coil portion and the other sealing portion.

8 Claims, 4 Drawing Sheets

U.S. PATENT DOCUMENTS

| | | | | |
|---|---|---|---|---|
| 2003/0006705 | A1 | 1/2003 | Alderman et al. | |
| 2004/0027075 | A1* | 2/2004 | Hataoka et al. | 315/115 |
| 2004/0075390 | A1* | 4/2004 | Kikuchi et al. | 313/631 |
| 2004/0119412 | A1* | 6/2004 | Katou et al. | 313/607 |
| 2004/0207327 | A1* | 10/2004 | Takahashi et al. | 313/639 |
| 2006/0197475 | A1* | 9/2006 | Yamamoto et al. | 315/330 |

FOREIGN PATENT DOCUMENTS

| | | | |
|---|---|---|---|
| JP | 2002-175780 | A | 6/2002 |
| JP | 2002-367566 | A | 12/2002 |
| JP | 2005-032521 | A | 2/2005 |
| JP | 2005-531116 | A | 10/2005 |
| JP | 2007-073436 | A | 3/2007 |
| WO | WO-2004/001793 | A1 | 12/2003 |

OTHER PUBLICATIONS

Written Opinion of International Search Authority of PCT/JP2011/056387, mailed May 10, 2011.

* cited by examiner

HIGH PRESSURE DISCHARGE LAMP

TECHNICAL FIELD

The present invention relates to a high pressure discharge lamp, and especially, relates to a high pressure discharge lamp capable of easily causing dielectric breakdown between a pair of electrodes provided in a light emission section by a trigger wire, which is provided so that a portion thereof near the light emission section of the high pressure discharge lamp is extended.

BACKGROUND ART

In general, application of a high pulse voltage is required at a start-up time for such a high pressure discharge lamp in order to cause dielectric breakdown between a pair of electrodes provided in a light emission section of the high pressure discharge lamp. Therefore, to easily start the high pressure discharge lamp was a subject matter of the prior art. In prior art, for example, an igniter, which generates a high pulse voltage, is disposed in a high pressure discharge lamp, or a starter such as a glow starter, is disposed in such a high pressure discharge lamp, in order to generate a high pulse voltage. However, a method of lighting by applying a high pulse voltage requires a suitable insulation for wiring, a socket, etc. Moreover, since the high pressure discharge lamp itself becomes large by building a starter in the high pressure discharge lamp, a miniaturization of the high pressure discharge lamp cannot be achieved. For this reason, the structure, in which the starting voltage of the high pressure discharge lamp is reduced, and high pulse voltage is not required, has been demanded.

For example, Patent Document 1 discloses a high pressure discharge lamp, in which two metal coils are wound around outer circumferences of small diameter cylindrical portions of both sides of an arc tube in order to reduce the starting voltage of the high pressure discharge lamp, and each metal coil extends to an opposite side of the arc tube and is connected so as to be the same as the opposite side electrode in electrical potential. Moreover, Patent Document 2 discloses a high pressure discharge lamp having a trigger wire, in which one side of the trigger wire is wound around an outer circumference of a sealing portion located at one end side of an arc tube, and the other side thereof crosses over a vicinity of the arc tube and is connected to an external lead, which extends out of an outer end of a sealing portion located at the other end of the arc tube, so that the trigger wire becomes the same as an external lead in electrical potential.

CITATION LIST

Patent Literature

Patent Document 1: Japanese Patent Application Publication No. 2002-175780

Patent Document 2: Japanese Patent Application Publication No. 2005-32521

SUMMARY OF INVENTION

Technical Problem to be Solved by the Invention

However, it was confirmed that although starting voltage can be reduced in the short term in such a conventional high pressure discharge lamp, the effect of reduction of the starting voltage gradually decreases as lighting and turning off are repeated over a long period of time. This is because when lighting and turning off of the high pressure discharge lamp are repeated over a long period of time, since the coil portion, which is wound around the outer circumference of the sealing portion, gradually loosens, a stretch-across portion connected to the coil portion, hangs down in a vertically downward direction, whereby a separation distance between the stretch-across portion and electrodes arranged in the light emission section is widened. That is, it is considered that although the effect of reducing starting voltage can be fully expected since the separation distance between the stretch-across portion and the electrodes is constant at an initial stage when the number of times of lighting and turning off of the high pressure discharge lamp is small, thermal expansion and contraction are repeated when lighting and turning off thereof are repeated many times, so that the separation distance between the stretch-across portion and the electrodes becomes larger than that at the beginning, whereby the effect of reducing the starting voltage cannot fully be acquired.

In view of the problem of the above-mentioned prior art, it is an object of the present invention to offer a high pressure discharge lamp capable of acquiring the effect of reducing the starting voltage over a long period of time, by preventing the stretch-across portion of the trigger wire, which extends near the light emission section, from hanging down.

Solution Measure to Solve the Problem

In the present invention, measures set forth below are used in order to solve the above-mentioned problems. According to a first measure, a high pressure discharge lamp comprises a light emission section in which a pair of electrodes is arrange so as to face each other, sealing portions continuously formed from both ends of the light emission section, external leads, each of which is held at the sealing portion and extends from an outer end of each sealing portion, and a trigger wire provided near the light emission section, wherein the trigger wire includes a first coil portion, which is wound from a vicinity of a boundary between the light emission section and one of the sealing portions towards an outer end of the one of sealing portions, and a linear stretch-across portion, which extends near the light emission section from the first coil portion towards the external lead extending from an outer end of the other sealing portion and is fixed to the external lead, wherein a second coil portion is formed in the other sealing portion, and wherein the wire, which forms the stretch-across portion, is held between the second coil portion and the other sealing portion. According to a second measure, in the high pressure discharge lamp according to the first measure, the second coil portion may be a separate member from the first coil portion. According to a third measure, in the high pressure discharge lamp in the first or second measure, the stretch-across portion may be held between a winding portion of the second coil portion other than a winding portion located closest to the light emission section side, and the other sealing portion. According to a fourth measure, in the high pressure discharge lamp in the first or second measure, the first coil portion and/or the second coil portion may have a dense part formed so that a coil pitch may become dense near the light emission section, and a non-dense portion formed so that the coil pitch thereof may become non-dense, compared with that of the dense portion, towards an outer end side of the sealing portion where the dense portion is formed. According to a fifth measure, in the high pressure discharge lamp according to the first or second measure, the high pressure discharge lamp may have a metallic foil, which is buried in each of the sealing portions, while one end of each metallic foil is connected to an end portion of each of the pair of electrodes, the other end of each metallic foil is connected to each external lead, wherein in the first coil portion and/or the second coil portion, the coil pitch of a circumference of the metallic foil is non-dense, compared with the coil pitch near the light emission section.

Advantageous Effects of Invention

According to the invention recited in claim 1, since the stretch-across portion is prevented from hanging down by the second coil portion even if lighting and turning off of the high pressure discharge lamp is repeated over a long period of time, a separation distance between the stretch-across portion of the trigger wire and the electrode arranged in the light emission section can be made constant over a long period of time. As a result, the effect of reducing the starting voltage of the high pressure discharge lamp can be acquired over a long period of time. According to the invention recited in claim 2, the trigger wire can be easily attached to the high pressure discharge lamp. According to the invention recited in claim 3, since the stretch-across portion can be disposed in a portion which is suitably distant from the light emission section, damage or devitrification in the light emission section can be prevented. According to the invention recited in claim 4, the temperature of the light emission section can be raised easily. According to the invention recited in claim 5, an excessive temperature rise of the metallic foil can be prevented.

DESCRIPTION OF EMBODIMENTS

A description of a first embodiment according to the present invention will be given, referring to FIG. 1.

Figure 1:
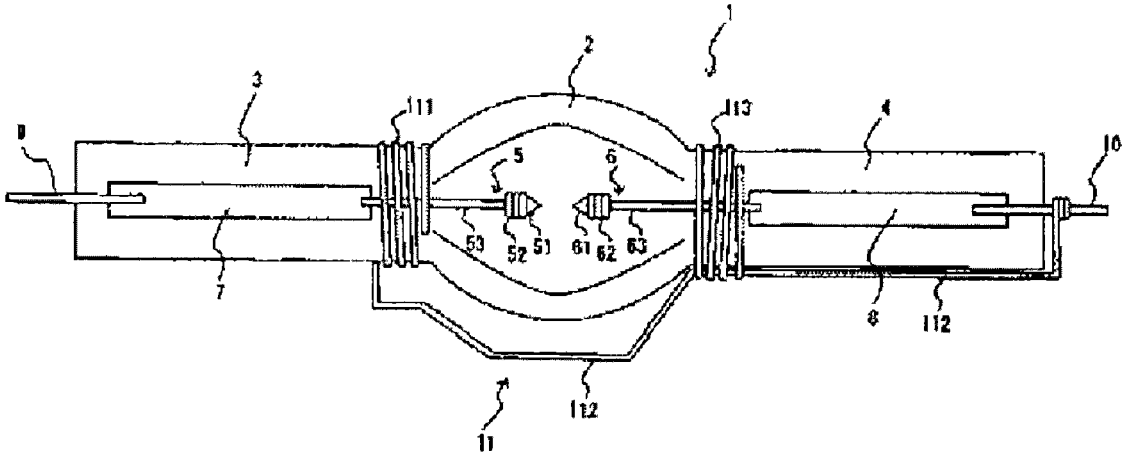
FIG. 1 It is an explanatory diagram showing a front cross sectional view of the structure of a high pressure discharge lamp according to a first embodiment.

FIG. 1 is an explanatory diagram showing a front cross sectional view of the structure of a high pressure discharge lamp according to a first embodiment. As shown in the figure, the high pressure discharge lamp 1 comprises a spherical light emission section 2 made of silica glass, and a pair of sealing portions 3 and 4, which are continuously formed from both ends of the light emission section 2, respectively. Moreover, 0.15 mg/mm3 or more of mercury is enclosed in the light emission section 2 so that the mercury vapor pressure thereof becomes 150 atm or more when the lamp is lighted at a steady lighting mode, and a pair of electrodes 5 and 6 is arranged so that tips thereof face each other.

As shown in the figure, the electrodes 5 and 6 comprise spherical head portions 51 and 61 on each of which a projection is formed, axis portions 53 and 63 connected to back sides of the head portions 51 and 61, and coil portions 52 and 62 provided on areas following the head portions 51 and 61 of these axis portions 53 and 63, wherein they are integrally formed and made of tungsten. The sealing portions 3 and 4 are airtightly sealed by burying therein metallic foils 7 and 8 made of molybdenum, respectively.

While one end of each of the metallic foils 7 and 8 is connected to an end of each of the axis portions 53 and 63, the other end thereof is connected to each external lead 9 and 10. Each of the external leads 9 and 10 extends towards the outside of each sealing portion 3 and 4.

Mercury is enclosed inside the light emission section 2 in order to obtain radiation light having a required visible light wavelength of, for example, 360-780 nm, and 0.15 mg/mm$^3$ or more thereof is enclosed, wherein although the amount thereof to be enclosed differs depending on temperature conditions, it is for forming extremely high steam pressure such as 150 atm or more at time of lighting. A discharge lamp, in which mercury vapor pressure is high, such as 200 atm or more or 300 atm or more at time of lighting, can be produced by enclosing much more mercury, whereby a light source suitable for a projector apparatus can be realized as the mercury vapor pressure becomes higher.

A noble gas is enclosed therein, for example, argon gas, whose amount is approximately 10 to 26 kPa in static pressure. Such a noble gas is enclosed in order to improve lighting starting nature. Moreover, a halogen such as iodine, bromine, chlorine, etc. is enclosed in the form of a compound thereof with mercury and other metal (s), and the enclosed amount of the halogen is selected from a range of 10-6 to 10-2 μmol/mm$^3$. Although a function thereof is for extending a life span (prevention of blackening) by using a halogen cycle, it is also for preventing devitrification of the light emission section, in case where it is very small and the inner pressure thereof is very high as the high pressure discharge lamp according to the present invention.

In this high pressure discharge lamp 1, a dielectric breakdown arises between the electrodes 5 and 6 by applying a voltage between the pair of electrodes 5 and 6 through the respective external leads 9 and 10 and metallic foils 7 and 8, whereby a plasma is formed therebetween. The spectrum of light emitted from the plasma covers a large range from the infrared region to the ultraviolet region.

As shown in FIG. 1, the trigger wire 11 has a first coil portion 111, which is wound around one sealing portion 3 and a stretch-across portion 112, which is connected to the first coil portion 111. The first coil portion 111 is wound towards an outer end of the one sealing portion 3 from a vicinity of a boundary between the light emission section 2 and the one sealing portion 3. The stretch-across portion 112, which is integrally connected to the first coil portion 111, extends around the light emission section 2 toward an outer end of the sealing portion 4, and is connected to the other external lead 10. The first coil portion 111, which is wound around the one sealing portion 3, is at the same potential as the other external lead 10, which extends towards an outside of the sealing portion 4. Furthermore, the second coil portion 113, which is physically independent of the first coil portion 111 and which is a separate member therefrom, is wound around the other sealing portion 4. As the stretch-across portion 112, which is connected to the first coil portion 111, extends around the light emission section 2, it passes inside the second coil portion 113, and is held between the second coil portion 113 and the glass of the other sealing portion 4. For example, an alloy of Fe and Cr is used as the material of the trigger wire 11, and the line diameter thereof is, for example, 0.3 mm in diameter.

Figure 2:
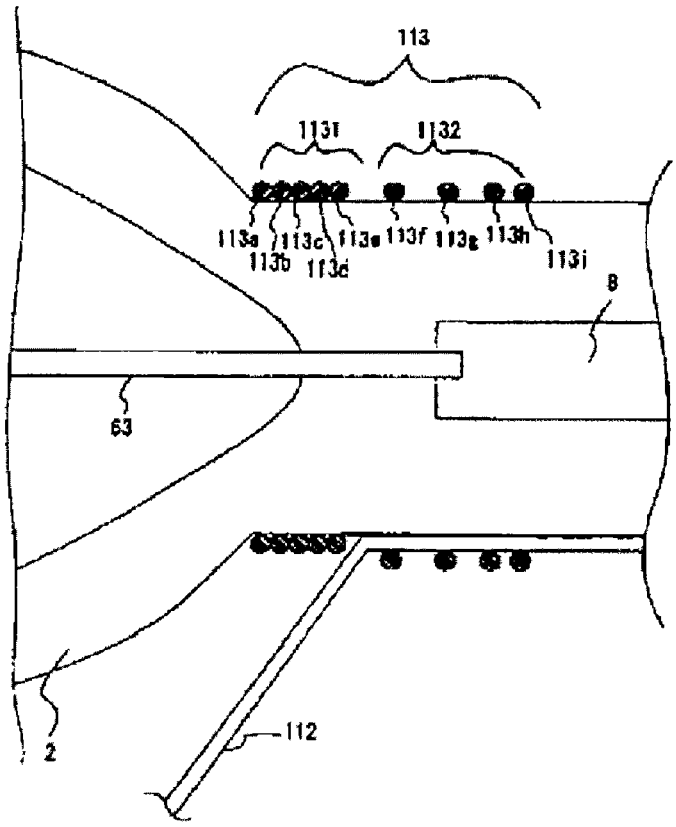
FIG. 2 It is an explanatory diagram showing a front cross sectional view of part of the structure of a high pressure discharge lamp according to a second embodiment.

Next, description of a second embodiment according to the present invention will be given referring to FIG. 2. FIG. 2 is an enlarged front cross sectional view of part of the structure around a light emission portion 2 and the other sealing portion 4 of a high pressure discharge lamp 1 according to the present embodiment.

As shown in the figure, the stretch-across portion 112 of a trigger wire 11, which extends near the light emission section 2, is held between the other sealing portions 4 and two or more winding portions, for example, winding portions 113*f*-113*i*, which form a second coil portion 113 except a winding portion 113*a* which is closest to the light emission section 2. Specifically, the stretch-across portion 112 is inserted in the inside of the winding portion 113*f*, which is the sixth turn thereof counted from the light emission section 2 side, among the two or more winding portions 113*a*-113*i*, which form the second coil portion 113.

Thus, as set forth below, there are two reasons for avoiding the winding portion 113*a*, which is the closest to the light emission section 2 of the second coil portion 113, as a winding portion for fixing the stretch-across portion 112. First, if the stretch-across portion 112 is brought too close to the light emission section 2, when the stretch-across portion 112 is in contact with the light emission section 2, there is a possibility that the light emission section 2 is damaged. Secondly, if the stretch-across portion 112 is brought too close to the light emission section 2, when the stretch-across portion 112 itself becomes high in temperature and is in contact with the light emission section 2, there is a possibility that devitrification of the light emission section 2 arises. It is considered that the devitrification arises because if the stretch-across portion 112 is in contact with the light emission section 2, the temperature of the contact portion of the light emission section 2 rises, or dirt on a surface of the stretch-across portion 112, etc. are taken into the light emission section 2, so that the glass of the light emission section 2 becomes cloudy and crystallizes. Thus, the stretch-across portion 112 can be disposed in a portion which is suitably distant from the light emission section 2, by inserting the stretch-across portion 112 in two or more winding portions except the winding portion 113*a* which is closest to the light emission section 2, among the winding portions 113*a*-113*i*, which form the second coil portion 113, for example, winding portions 113*f*-113*i*.

Furthermore, for example, as shown in FIG. 2, in the high pressure discharge lamp according to the present embodiment, the second coil portion 113 has, for example, a dense portion 1131, which is wound near a boundary between the light emission section 2 and the other sealing portion 4, wherein each coil gap of adjoining winding portions 113*a*-113*e* is small, and for example, a non-dense portion 1132, which is wound on an other sealing portion 4 outer end side (on a right side of the figure) of the of the dense portion 1131, wherein each coil gap of adjoining winding portions 113*f*-113*i* is large. Here, intervals between adjoining coils are 0.3 mm or less in the dense portion 1131, and intervals between adjoining coils are 0.5 mm or more, for example 2.3 mm, in the non-dense portion 1132. That is, as shown in the figure, in the second coil portion 113, the coil pitch of the dense portion 1131, which is a region in the other sealing portion 4 near the light emission section 2, is small, and the coil pitch of the non-dense portion 1132, which is a region distant from the light emission section 2 in the other sealing portions 4, is large. Thus, since a heat insulation effect of the light emission section 2 can be expected by making the coil pitch dense in the winding portion close to the light emission section 2, the temperature of the light emission section 2 can be raised. Moreover, it is possible to make temperature of a vicinity of the metallic foil 8 comparatively low by making the coil pitch non-dense in the winding portion which is a region distant from the light emission section 2. There is no possibility that the metallic foil 8 and the glass of the other sealing portion 4 may break away, by making the circumference of the metallic foil 8 comparatively low in temperature. In addition, although not shown in the drawings, the coil pitch of the first coil portion 111 may also be configured similarly to the above-mentioned second coil portion 113.

Figure 3:
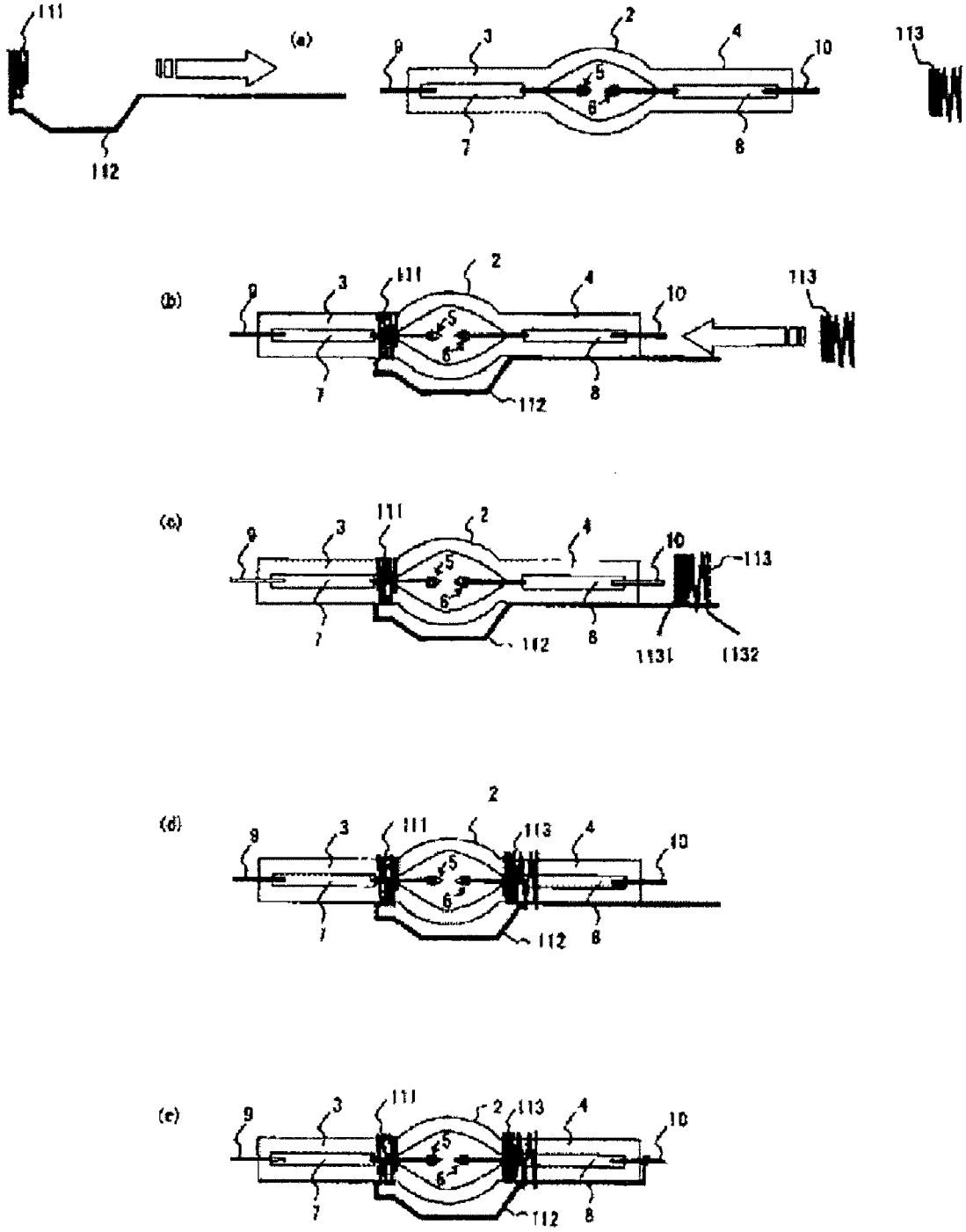
FIG. 3 (*a*)-(*e*) are explanatory diagrams showing an example of an installing method of a trigger wire in a high pressure discharge lamp according to a second embodiment, in an order of steps thereof.

FIG. 3 shows an installation method of the trigger wire in the high pressure discharge lamp according to the present embodiment. First, as shown in FIG. 3 (*a*), the first coil portion 111 of the trigger wire 11, which is made up of the first coil portion 111 formed in a predetermined shape, and the stretch-across portion 112, is inserted, for attachment, up to a vicinity of a boundary between the one sealing portion 3 and the light emission section 2 from a side of the one sealing portion 3. Next, as shown in FIG. 3 (*b*), the stretch-across portion 112 is made so as to extend along the light emission section 2 and the other sealing portion 4. Next, as shown in FIG. 3 (*c*), the stretch-across portion 112 is arranged so as to be located outside the dense portion 1131 of the second coil portion 113 and to be inserted inside the non-dense portion 1132. Next, as shown in FIG. 3 (*d*), in the state shown in FIG. 3 (*c*), the second coil portion 113 is inserted, for attachment, up to a vicinity of a boundary of the other sealing portion 4 and the light emission section 2, from a side of the other sealing portion 4. Next, as shown in FIG. 3 (*e*), a tip part of the stretch-across portion 112 is fixed to the other external lead 10.

Figure 4:
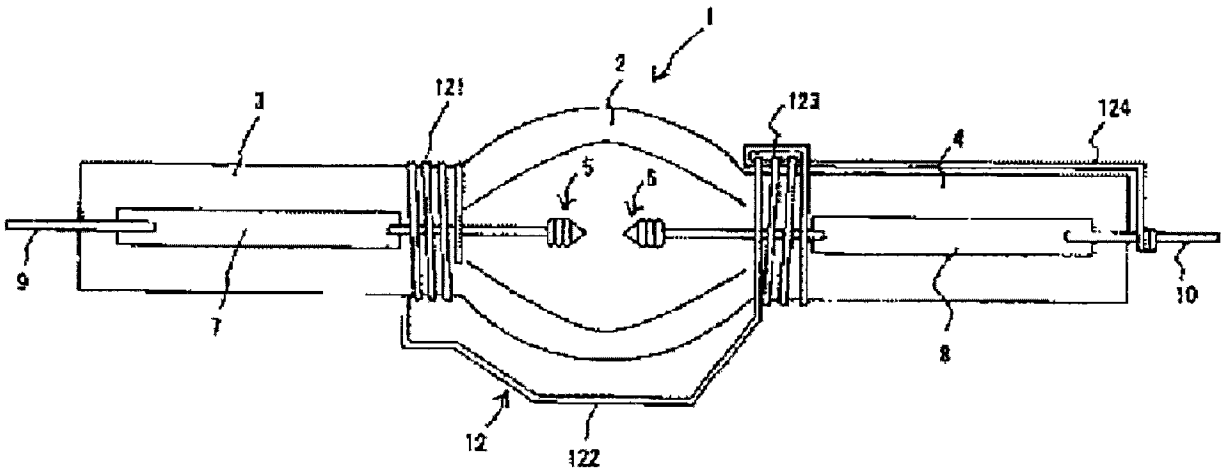
FIG. 4 It is an explanatory diagram showing a front cross sectional view of the structure of a high pressure discharge lamp according to a third embodiment.

Next, description of a third embodiment according to the present invention will be given referring to FIG. 4. FIG. 4 is a front cross sectional view, showing the structure of a high pressure discharge lamp according to the present embodiment. A trigger wire 12 according to the present embodiment is different from the trigger wire 11 according to the first embodiment shown in FIG. 1, in that a first coil portion 121 and a second coil portion 123 are made from one trigger wire. As shown in the figure, the trigger wire 12 according to the present embodiment, comprises the first coil portion 121 disposed around one sealing portion 3, a stretch-across portion 122, which extends along a light emission section 2 following the first coil portion 121, the second coil portion 123, which is wound around the other sealing portion 4 following the stretch-across portion 122, and a connection part 124 following the second coil portion 123, wherein they are integrally formed. The trigger wire 12 becomes the same as the other external lead 10 in electrical potential by winding the connection part 124 around the other external lead 10.

More specifically, the first coil portion 121 is disposed near a boundary between the light emission section 2 and the one sealing portion 3, and is wound towards an outer end of the one sealing portion 3 from the boundary between the light emission section 2 and the one sealing portion 3. The stretch-across portion 122 is stretched across a vicinity of the light emission section 2 between the one sealing portion 3 and the other sealing portion 4 so as to be along the light emission section 2. The second coil portion 123 is disposed near the boundary between the light emission section 2 and the other sealing portion 4, and is wound towards an outer end of the other sealing portion 4 from the boundary between the light emission section 2 and the other sealing portion 4. The connection part 124 following the second coil portion 123 extends towards the light emission section 2 outside the second coil portion 123 is folded in a counter direction around the light emission section 2 so as to form a U-character shape, passes through the inside of the second coil portion 123, extends in an outer end direction of the other sealing portion 4, and is wound around and connected to the other external lead 10.

REFERENCE SIGNS LIST

1 High pressure discharge lamp
2 Light emitting section
3 One sealing portion
4 Other sealing portion
5 and 6 Electrodes
51 and 61 Head portions
52 and 62 Coil portions
53 and 63 Axis portions
7 and 8 Metallic foils
9 One external lead
10 Other external Lead
11 Trigger wire
111 First coil portion
112 Stretch-across portion
113 Second coil portion
113*a*-113*i* Winding portions
1131 Dense portion
1132 Non-dense portion
12 Trigger wire
121 First coil portion
122 Stretch-across portion
123 Second coil portion
124 Connecting portion

The invention claimed is:

1. A high pressure discharge lamp comprising:

a light emission section in which a pair of electrodes is arrange so as to face each other, sealing portions continuously formed from both ends of the light emission section, external leads, each of which is held at each sealing portion and extends from an outer end of each sealing portion, and a trigger wire provided near the light emission section, wherein the trigger wire includes a first coil portion, which is wound from a vicinity of a boundary between the light emission section and one of the sealing portions towards an outer end of the one of sealing portions, and a linear stretch-across portion, which extends from the first coil portion near the light emission section towards the external lead extending from an outer end of the other sealing portion and is fixed to the external lead, wherein a second coil portion is formed around the other sealing portion, and wherein the wire, which forms the stretch-across portion, is held between the second coil portion and the other sealing portion.

2. The high pressure discharge lamp according to claim 1, wherein the second coil portion is a separate member from the first coil portion.

3. The high pressure discharge lamp according to claim 1, wherein the stretch-across portion is held between a winding portion of the second coil portion other than a winding portion located closest to a side of the light emission section and the other sealing portion.

4. The high pressure discharge lamp according to claim 1, wherein at least one of the first coil portion and the second coil portion has a dense part formed so that a coil pitch may become dense near the light emission section, and a non-dense portion formed so that a coil pitch thereof may become non-dense, compared with the that of the dense portion, towards an outer end side of the sealing portion where the dense portion is formed.

5. The high pressure discharge lamp according to claim 1, wherein the high pressure discharge lamp has metallic foils, each of which is buried in each of the sealing portions, where one end of each metallic foil is connected to an end portion of the pair of electrodes, and the other end of each metallic foil is connected to one of the external leads, wherein in at least one of the first coil portion and the second coil portion, the coil pitch around the metallic foil is large, compared with the coil pitch near the light emission section.

6. The high pressure discharge lamp according to claim 2, wherein the stretch-across portion is held between a winding portion of the second coil portion other than a winding portion located closest to a side of the light emission section and the other sealing portion.

7. The high pressure discharge lamp according to claim 2, wherein at least one of the first coil portion and the second coil portion has a dense part formed so that a coil pitch may become dense near the light emission section, and a non-dense portion formed so that a coil pitch thereof may become non-dense, compared with the that of the dense portion, towards an outer end side of the sealing portion where the dense portion is formed.

8. The high pressure discharge lamp according to claim 2, wherein the high pressure discharge lamp has metallic foils, each of which is buried in each of the sealing portions, where one end of each metallic foil is connected to an end portion of the pair of electrodes, and the other end of each metallic foil is connected to one of the external leads, wherein in at least one of the first coil portion and the second coil portion, the coil pitch around the metallic foil is large, compared with the coil pitch near the light emission section.

* * * * *